US006024797A

United States Patent [19]

Li et al.

[11] Patent Number: 6,024,797

[45] Date of Patent: Feb. 15, 2000

[54] METHOD AND APPARATUS FOR CONTROLLING COAT-WEIGHT PROFILE

[75] Inventors: Alfred C. Li, Naperville, Ill.; Rex A. Becker, Janesville, Wis.

[73] Assignee: Beloit Technologies, Inc., Wilmington, Del.

[21] Appl. No.: 09/050,495

[22] Filed: Mar. 30, 1998

[51] Int. Cl.[7] ..... B05C 3/02

[52] U.S. Cl. ..... 118/665; 118/413

[58] Field of Search ..... 118/413, 419, 118/665, 410, 411, 261; 427/356

[56] References Cited

U.S. PATENT DOCUMENTS

| | | | |
|---|---|---|---|
| 2,946,307 | 7/1960 | Warner . | |
| 3,245,377 | 4/1966 | Gettel . | |
| 4,791,879 | 12/1988 | Eklund et al. | 118/413 |
| 4,873,939 | 10/1989 | Eskelinen | 118/410 |
| 5,173,120 | 12/1992 | Suzumura et al. | 118/410 |
| 5,432,353 | 7/1995 | Goss et al. . | |
| 5,583,782 | 12/1996 | Heaven et al. . | |
| 5,665,163 | 9/1997 | Li et al. | 118/413 |
| 5,882,406 | 3/1999 | Becker et al. . | |

*Primary Examiner*—Brenda A. Lamb

[57] ABSTRACT

A method and apparatus for applying a uniform coating to a moving paper web by utilizing a coating applicator with regional cross-machine zones from which coating quality or excess coating can be monitored and analyzed. As the coating conditions vary between regional zones, upstream liquid coating flow parameters can be varied for a particular region to render uniform coating profiles across the entire machine-direction of the web.

16 Claims, 2 Drawing Sheets

METHOD AND APPARATUS FOR CONTROLLING COAT-WEIGHT PROFILE

FIELD AND BACKGROUND OF THE INVENTION

This invention relates generally to methods and apparatus for applying uniform coatings to a moving web of paper, and more particularly to a method and apparatus for coating a moving web using a coater having multiple extraction ports in the application zone between a static converging wedge and a dynamic converging wedge that interact to control the amount of liquid coating material applied to moving web and provide regional excess coating liquid and air content removal to better control coating uniformity in a cross-machine direction. An optional coating sensor can be used downstream from a final metering element to further control coat-weight profiles by adjusting the removal rate locally.

In some known methods for controlling a profile of coating on a backing roll or a substrate, a flexible metering element is positioned with its edge adjacent to the substrate to remove excess coating on the substrate. Pressurized tubes or single-profile solid bars have been used to apply a biasing force to the flexible blade or other metering element such as a rod or plate to counter the dynamic forces of liquid coating moving along with the surface of the web to be coated. In this manner, the metering element will control the coat-weight profile in a cross-machine direction. However, coat-weight non-uniformity will occur during the coating process due to varying flow conditions inside the coating applicator, changing coating rheologies, web speeds, metering blade wear, and non-uniform backing roll wear. The conventional approach to regain uniformity has been to increase or decrease localized pressure against the metering element to minimize high or low-coat weight regions. Although providing satisfactory coating profiles, the metering element and the backing roll experience accelerated wear, particularly in the local regions of higher pressure. Rigid metering elements also have been used to control coating profiles. Rigid metering elements such as a rod or plate, are uniformly adjustable along their length using air tubes or hydraulic actuators. With rigid metering elements, adjusting coating profile in a cross-machine direction is limited and, in some instances, not possible.

Therefore, it is desirable to have a method for using a coating applicator to adjust coat-weight profiles in a cross-machine direction at high machine speeds and without excessive metering element wear or backing role wear.

SUMMARY OF THE INVENTION

Methods and apparatus in accordance with the present invention overcome the above-described problems associated with prior art short-dwell coaters and metering size presses with rods that rely on the application of differential pressure applied to flexible metering elements or rigid metering elements having little or no cross-machine adjustability. A coating applicator in accordance with the present invention provides regional zone extraction ports between a pair of converging wedges to control dynamic fluid forces and regain required coat-weight uniformity or film thickness without using excessive loading on a metering element. An optional final metering element downstream from the converging wedges can further control the coat-weight profile, if desired.

One embodiment of such a coater includes: an adjustable coating inlet for receiving a fluid coating; a static converging wedge downstream from the coating inlet for directing the flow fluid coating material against a moving paper web; an overflow outlet for receiving coating material from the coating inlet, and draining fluid coating material that does not flow through the static converging wedge; a dynamic converging wedge downstream from the static converging wedge, for directing fluid coating material against the moving paper web; and a plurality of regional extraction ports arrayed in a cross-machine direction for selectively draining coating fluid from an upstream side of the dynamic converging wedge and a downstream side of the static converging wedge.

The dynamic converging wedge may include: a wedge adapted to move in a direction normal to the surface of the moving paper web; a mechanism for urging the wedge toward the surface of the moving paper web; and an element for biasing the wedge away from the surface of the moving paper web. The mechanism for urging the wedge toward the surface of the moving paper web can include an air tube. The biasing element can include a spring retractor.

The dynamic converging wedge may include a flexible blade having a proximate end fixed to the coater head and a distal end spaced from the moving paper web or a rod disposed in a cross-machine direction adjacent to the surface of the paper web. When a rod is used, the rod may be smooth or grooved, and may be fixed or rotatable.

In another embodiment, the dynamic converging wedge may include: an adjustable rigid plate having a proximate end pivotally joined to the coating applicator and a distal end adapted to be disposed adjacent to surface of a moving paper web.

The coater may include an optional metering blade downstream from the dynamic converging wedge and a return port downstream from the dynamic converging wedge and upstream from the metering blade for recycling excess coating fluid.

A method for using a coating applicator as described above may include the steps of: feeding coating liquid to the inlet, through the adjustable width slot, and over the static converging wedge. Once past the static converging wedge, the flow of coating liquid is directed toward and over the dynamic converging wedge, with excess coating flowing through the regional extraction ports. The removal rate of excess coating fluid through the regional extraction ports depends upon the coat weight profile on the substrate. If the regional coat weight is high, the removal rate through the extraction port is increased. If the regional coat weight is low, the removal rate is decreased to minimize non-uniform profile. Preferably, the extraction ports have regions of variable adjustability in the cross-machine direction to provide optimal control of the coating profile.

Similarly, air entrainment at the triple point will dictate whether overflow through the upstream overflow outlet is balanced at a triple point sufficiently upstream from the applicator to maintain air entrainment at acceptable levels. The "triple point" is the location where liquid coating material, the paper web, and atmospheric air all meet. The triple point location is controlled by balancing the pressure of coating liquid inside the coating applicator with atmospheric pressure, which itself may be controllable by applying a vacuum on the upstream side of the coater. Thus, when the triple point is too close to a metering element in a coater, there will be high levels of entrained air in the liquid coating material that causes streaks in the finished coating.

Further, complicating the maintenance of the optimal triple point location is a very high web speed, which adds significant energy to the liquid coating material and can adversely affect the inlet pressure. Also, liquid coating rheology affects flow conditions, and therefore internal pressure, of the liquid coating.

All of these properties can vary in the cross-machine direction and the normal approach to controlling coating quality is to adjust the pre- or final metering element such as blades or rods. As stated above, placing all of the demand on the pre- or final metering element causes excessive metering element wear and can ultimately cause web breakage that can damage the coater or cause expensive lost production while bringing the machine back on line.

Thus, monitoring excess coating conditions at regional extraction ports upstream from the final metering element provides a wealth of information that can be used to control the amount and quality of liquid coating material reaching the pre- or final metering element, thereby reducing the load and wear on the metering element. A scanning device downstream from the coating applicator element can be used to monitor coating quality. Streaks detected by the scanning device at various cross-machine regions indicate the need to adjust metering elements, flow volume or triple point location as described above.

As this invention is described more fully below, it will be readily apparent that regional extraction ports and downstream scanning devices provide information useful in controlling upstream coating conditions to provide optimal coating quality at high line speeds.

DETAILED DESCRIPTION OF THE DRAWINGS

Figure 1:
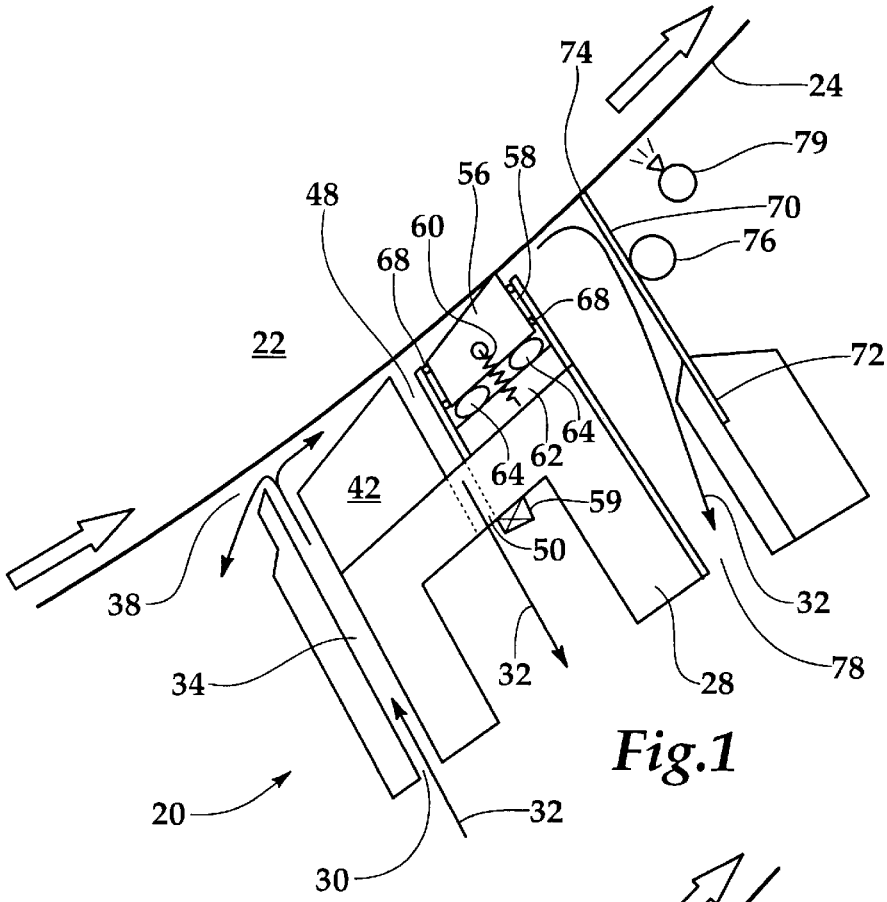
FIG. 1 is a sectional view of a coating applicator in accordance with the present invention having a static converging wedge and a dynamic converging wedge upstream from an optional metering blade.

In the following detailed description of the drawings, the same reference numerals will be used to identify the same or similar item in each of the figures. Illustrated generally in FIG. 1 is a first coating applicator 20 positioned under a backing roll 22 that is rotating in a clockwise direction. Between the backing roll 22 and the first coating applicator is a traveling paper web 24 moving in a generally upward direction at the same speed as the backing roll 22.

The first coating applicator 20 includes a housing 28 having an inlet 30 for receiving a liquid coating material 32. The inlet 30 has an adjustable width slot 34 that controls the amount of liquid coating material 32 that can enter the coating applicator 20 and be applied to the paper web 24. Preferably, the inlet 30 has a number of cross-machine regions that are each adjustable for controlling inlet flow on a regional basis.

Once through the adjustable width slot 34, the liquid coating material 32 adheres to the paper web 24 and receives a considerable amount of dynamic energy from the high speed movement of the paper web 24. Some of the liquid coating material 32 travels in the same direction as the paper web 24, and some of the liquid coating material 32 flows opposite the direction of the paper web 24 through an overflow outlet 38 that recycles liquid coating material 32.

A vacuum may be applied at the overflow outlet 38 to control the pressure at the overflow outlet 38 relative to the liquid the coating pressure inside the coating applicator 20. This control is important because it determines the location of the "triple point" which is where liquid coating material 32, the paper web 24, and atmospheric air all meet. The location of the triple point relative to a coater metering element can have an affect on air entrainment in the final coating. Too much air in the final coating can result in undesirable streaks.

Downstream from the adjustable width slot 34 is a static converging wedge 42 which together with the paper web 24, defines a converging wedge-shaped conduit through which liquid coating material 32 flows. The static converging wedge 42 is spaced apart from the paper web 24 to provide a first control on the volume of liquid coating material 32 traveling with the paper web 24 toward a downstream metering element. The static converging wedge 42 is fixed in relation to the coating applicator housing 28 and is illustrated as having a planar top surface and sharp corners although other shapes can be used for the top surface and the corners, as coating speeds and coating liquid rheology conditions require.

Downstream from the static converging wedge 42 is a downwardly extending pond 48 at the bottom of which is located a number of regional extraction ports 50 which are described in more detail below. Adjacent to the downstream side of the downwardly extending pond 48, there is a dynamic converging wedge 56 which is disposed for movement relative to the coating applicator housing 28 inside of a recess 58. The dynamic converging wedge 56 is biased in a direction away from the paper web 24 by a spring retractor 60 that has one end mounted on the dynamic converging wedge 56 and the other on a base plate 62. Opposing the bias of the spring retractor 60 is a pair of air tubes 64 disposed between the dynamic converging wedge 56 and a base plate 62. The air tubes 64 can be inflated or deflated to move the dynamic converging wedge 56 toward or away from the paper web 24, respectively. The air tubes 64 can be inflated or deflated in any conventional manner.

The dynamic converging wedge 56 defines a second wedge-shaped conduit through which liquid coating material 32 flows. Although not intended to be drawn to scale, the relative spacing between the paper web 24 and the static converging wedge 42 and the dynamic converging wedge 56 is apparent from the FIG. 1 with the static converging wedge 42 spaced farther from the web 24 than the dynamic converging wedge 56. As stated above, the static converging wedge 42 preliminarily controls the amount of liquid coating material 32 traveling along surface of the paper web 24. The dynamic converging wedge 56 further controls and may be the final control on the amount of liquid coating material 32 traveling on the paper web 24. The dynamic converging wedge 56 is illustrated as having a planar upper surface and sharp corners, but other upper surface and corner shapes can be used in accordance with the present invention. To protect the spring retractor 60 and the air tubes 64 from contamination by the liquid coating material 32, o-ring seals 68 are preferably used between the dynamic converging wedge 56 and the recess 58, as illustrated.

Liquid coating material 32 that is unable to pass over the dynamic converging wedge 56 flows down the downwardly extending pond 48 and out of the regional extraction ports 50 to be recycled back through the coating applicator 20. Liquid coating 32 passing through the regional extraction ports 50 is monitored in a number of ways e.g. an air entrainment monitor 59 to improve coating quality and uniformity in a cross-machine direction. For example, the volume of liquid coating material 32 passing through regional extraction ports 50 can be varied by adjusting the dynamic converging wedge 56, extraction port opening size, or inlet pressure of liquid coating material are necessary. The liquid flow rate through the extraction ports can be controlled by a plurality of valves, each valve corresponding to a cross machine region. Changing any of these coating parameters can impact and improve coating quality, uniformity, and thickness across the entire web.

Also depicted FIG. 1 is an optional metering blade 70 downstream from the dynamic converging wedge 56. The optional metering blade 70 has a proximate end 72 fixed to the applicator housing 28 and a distal end 74 spaced closely to the paper web 24. The spacing of the distal end 74 to the paper web 24 is controllable using an adjustment means 76 which can include an air tube for a pneumatically controlled bar extending in the cross-machine direction. Excess coating material 32 that does not pass over the optional metering blade 70 is recycled through a metering zone outlet 78.

A coater scanning device 79 is positioned downstream from the coating applicator 20 to monitor coating thickness and streaking of the final coating. If coating thickness or streak formation exceeds tolerances, adjustment to the removal rate of the excess coating can be made to compensate the non-uniformity as described above. Suitable scanning devices are disclosed in U.S. Pat. Nos. 5,432,353 and 5,583,782.

Figure 2:
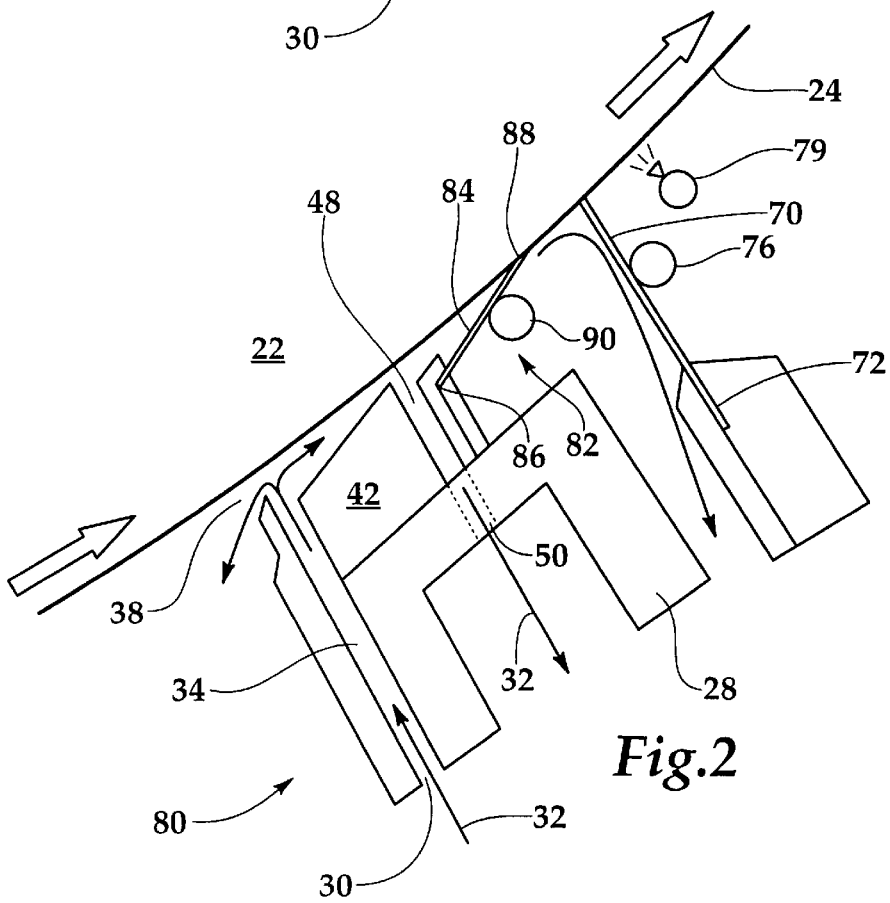
FIG. 2 is a sectional view of an alternate embodiment of a coating applicator in accordance with the present invention having a flexible blade at least partially defining the dynamic converging wedge.

Illustrated in FIG. 2 is a second coating applicator 80 having a housing 28, an inlet 30 with adjustable width slot 34, an overflow outlet 38, a static converging wedge 42, a downwardly extending pond 48, regional extraction ports 50, an optional metering blade 70, and a scanning device 79. The primary difference between the second coating applicator 80 and the first coating applicator 20 (FIG. 1), is that the dynamic converging wedge 82 illustrated in the second coating applicator 80 is formed by a flexible blade 84 having a proximate end 86 joined to the housing 28 and a distal end 88 positioned adjacent to the paper web 24. The flexible blade 84 can be maintained close to the paper web 24 by a rod or air tube 90 extending in the cross-machine direction that is adjustable using known techniques.

Figure 3:
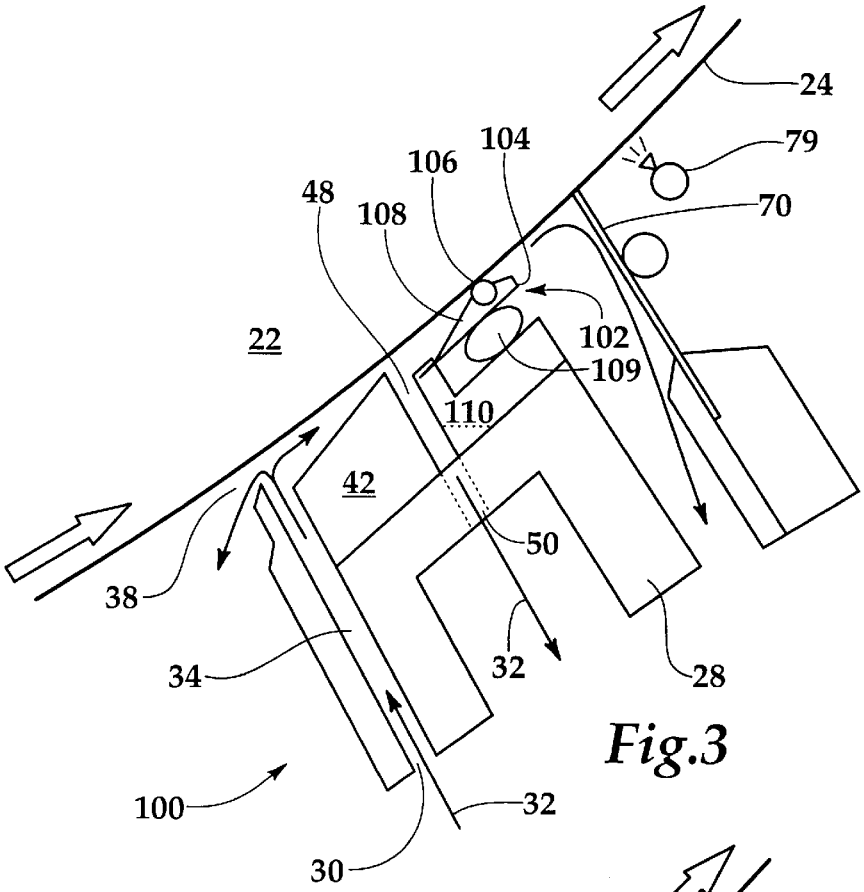
FIG. 3 is a sectional view of a second alternate embodiment having a rod disposed in the cross-machine direction to partially define a dynamic converging wedge.

Illustrated in FIG. 3 is a third coating applicator 100 having a housing 28, an inlet 30, an adjustable width slot 34, an overflow outlet 38, a static converging wedge 42, a downwardly extending pond 48, regional extraction ports 50, an optional metering blade 70, and a scanning device 79. Again, the primary difference in the third coating applicator 100 is in the dynamic converging wedge 102 which in this case includes a cantilevered plate 104 supporting thereon a rod 106 extending in a cross-machine direction. The rod 106 can be supported in a wedge-shaped bevel 108 to improve flow characteristics around the rod 106. The rod 106 can be fixed to rotation or be rotatable in a direction opposed to or in the same direction of the traveling web 24 to obtain desired coating characteristics and thicknesses for a given liquid coating material 32. Further, the rod 106 can be smooth or grooved as necessary. The cantilevered plate 104 can be urged toward or retracted from the paper web 24 by inflating or deflating, respectively, an air tube 109 positioned under the cantilevered plate 104 and on top of a fixed base portion 110.

Figure 4:
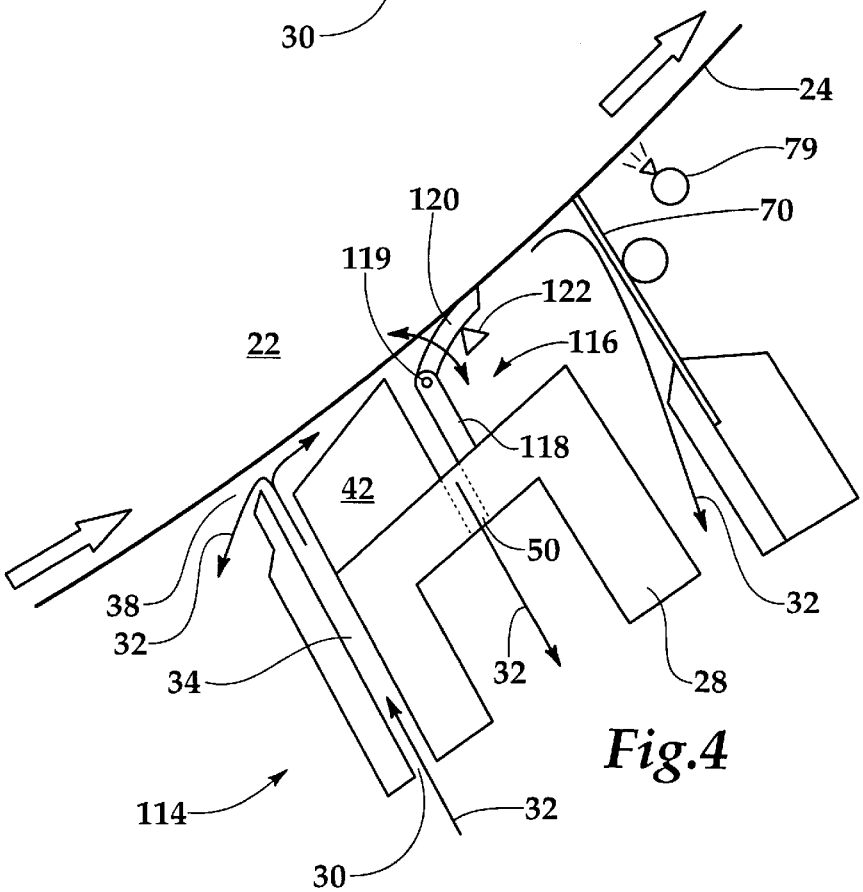
FIG. 4 is a sectional view of a third alternate embodiment having an adjustable rigid plate partially defining a dynamic converging wedge.

Next, illustrated in FIG. 4, is a fourth coating applicator 114 in accordance with present invention having a housing 28, an inlet 30, an adjustable width slot 34, an overflow outlet 38, a static converging wedge 42, a downwardly extending pond 48, regional extraction ports 50, an optional metering blade 70, and a scanning device 79. In this embodiment, a dynamic converging wedge 116 includes an upstanding wall member 118 having a distal end 119 to which an adjustable rigid plate 120 is pivotally mounted. The adjustable rigid plate 120 preferably includes an arcuate top surface for optimum flow characteristics over the rigid plate 120. The rigid plate 120 has a distal end that is adjustable relative to the paper web 24 using any suitable loading and retracting mechanism 122, such as an air tube or hydraulicly operated bar oriented in a cross-machine direction.

Using any of the above-described coating applicators, excess liquid coating flow rates can be controlled by regional extraction port size. The parameter can be determined by monitoring final coating profile. If monitoring the final coating determines that inferior performance is localized, adjustments can be made to the coating applicator on a regional basis to improve overall coating quality.

The foregoing detailed description of drawings is presented for clearness of understanding only and no unnecessary limitations therefrom should be read into the following claims.

We claim:

1. A coating applicator for applying coating material to a moving substrate along a direction of travel said apparatus comprising:

a housing having a coating inlet for receiving a fluid coating material;

a static converging wedge mounted to the housing downstream from the coating inlet for directing the flow of fluid coating material against a moving substrate;

an overflow outlet upstream from the coating inlet for draining fluid coating material that does not flow through the static converging wedge;

a dynamic converging wedge downstream from the static converging wedge for directing fluid coating material against the moving substrate; and a plurality of regional extraction ports arrayed in a cross-machine direction for selectively draining fluid coating material from an upstream side of the dynamic converging wedge a coater scanning device downstream of the housing, the scanner directed at the coating on the moving substrate;

a controller, including a means for selectively varying the opening size of the regional extraction ports, the controller responsive to the coater scanning device and selectively controlling liquid coating flow rates through the regional extraction ports.

2. The coating applicator of claim 1, wherein the dynamic converging wedge comprises:

a wedge adapted to move in a direction normal to the surface of the moving paper web;

means for urging the wedge toward the surface of the moving substrate; and means for biasing the wedge away from the surface of the moving paper web.

3. The coating applicator of claim 2, wherein the means for urging the wedge toward the surface of the moving substrate comprises an air tube.

4. The coating applicator of claim 2, wherein the means for biasing the wedge away from the surface of the moving substrate comprises a spring retractor.

5. The coating applicator of claim 1, wherein the dynamic converging wedge comprises a flexible blade.

6. The coating applicator of claim 1, wherein the dynamic converging wedge comprises:

a rod disposed in a cross-machine direction.

7. The coating applicator of claim 6, wherein the rod is smooth.

8. The coating applicator of claim 6, wherein the rod is grooved.

9. The coating applicator of claim 6, wherein the rod is rotatable.

10. The coating applicator of claim 1, wherein the dynamic converging wedge comprises:

an adjustable rigid plate having a proximate end pivotally joined to the coating applicator and a distal end adapted to be disposed adjacent to the surface of the moving.

11. The coating applicator of claim 1, and further comprising a metering element downstream from the dynamic converging wedge.

12. The coating applicator of claim 1, and further comprising:

a metering blade downstream from the dynamic converging wedge; and a metering zone outlet downstream from the dynamic converging wedge and upstream from the metering blade for receiving excess fluid coating material.

13. A coating applicator comprising:

a housing having a coating inlet for receiving a fluid coating material;

a static converging wedge mounted to the housing downstream from the coating inlet for directing flow of the fluid coating material against a moving substrate;

an overflow outlet upstream from the coating inlet for draining the fluid coating material that does not flow through the static converging wedge;

a plurality of cross-machine regions;

a plurality of regional extraction ports each corresponding to a cross-machine region;

a scanning device downstream of the housing for monitoring coating quality in the cross-machine direction and generating coating quality data; and a controller that is responsive to the coating quality data to selectively control liquid coating flow rates through the regional extraction ports.

14. The coating applicator of claim 13, and further comprising:

an air entrainment monitor for monitoring entrained air content of excess liquid coating flowing through a plurality of the regional extraction ports and generating air content data for the monitored regional extraction ports; and a triple point controller responsive to the air content data to selectively adjust triple point location upstream from the regional extraction ports.

15. The coating applicator of claim 13, wherein the controller comprises a dynamic converging wedge downstream from the regional extraction ports.

16. The coating applicator of claim 13, where the controller comprises a plurality of valves each corresponding to a cross-machine region.

* * * * *